US007503472B2

(12) United States Patent
Marks

(10) Patent No.: US 7,503,472 B2
(45) Date of Patent: Mar. 17, 2009

(54) SPRING ENERGIZED DESKTOP STAPLER

(75) Inventor: Joel Marks, Sherman Oaks, CA (US)

(73) Assignee: Worktools, Inc., Chatsworth, CA (US)

( * ) Notice: Subject to any disclaimer, the term of this patent is extended or adjusted under 35 U.S.C. 154(b) by 0 days.

(21) Appl. No.: 11/444,257

(22) Filed: May 31, 2006

(65) Prior Publication Data

US 2006/0213948 A1 Sep. 28, 2006

Related U.S. Application Data

(60) Division of application No. 11/065,781, filed on Feb. 24, 2005, which is a continuation of application No. 10/443,854, filed on May 23, 2003, now Pat. No. 6,918,525.

(51) Int. Cl.
*B25C 5/00* (2006.01)

(52) U.S. Cl. ..... 227/120; 227/107; 227/128

(58) Field of Classification Search ..... 227/107, 227/120, 131, 132, 134, 156; 29/243.56
See application file for complete search history.

(56) References Cited

U.S. PATENT DOCUMENTS

| | | | | |
|---|---|---|---|---|
| 1,956,174 | A | 4/1934 | Maynard | |
| 2,142,782 | A | 1/1939 | Gillette | |
| 2,218,794 | A | 10/1940 | Kilbride | |
| 2,271,479 | A | 1/1942 | Gambao | |
| 2,279,584 | A * | 4/1942 | Vogel | 227/126 |
| 2,421,429 | A | 6/1947 | Obstfeld | |
| 2,657,384 | A | 11/1953 | Boroughs | |
| 2,726,391 | A | 12/1955 | Pilblad | |
| 2,733,440 | A | 2/1956 | Jenny | |
| 2,884,636 | A | 5/1959 | Abrams | |
| D186,342 | S | 10/1959 | Marano | |
| 2,915,753 | A | 12/1959 | Ruskin | |
| 3,034,128 | A | 5/1962 | Robbins | |
| 3,630,428 | A * | 12/1971 | Olney et al. | 227/128 |
| 3,758,016 | A | 9/1973 | Olney et al. | |
| 3,889,865 | A * | 6/1975 | Kuypers | 227/109 |
| D243,148 | S | 1/1977 | Levin | |

(Continued)

FOREIGN PATENT DOCUMENTS

| | | |
|---|---|---|
| DE | 28 56 621 | 7/1980 |

(Continued)

*Primary Examiner*—Rinaldi I. Rada
*Assistant Examiner*—Nathaniel Chukwurah
(74) *Attorney, Agent, or Firm*—Paul Y. Feng; Fulwider Patton LLP

(57) ABSTRACT

A desktop stapler uses a spring to store energy to install staples by impact blow. The force required to fasten papers together is reduced. A very compact mechanism is used, including a dual coil power spring with a nested lever. A multi-function base provides a sloped front all the way down to a desktop surface to guide paper sheets atop the base, easy access for lifting the stapler off a desk while in its horizontal or vertical resting positions, and integrated soft grip under surface. The base surrounds the rear of the stapler body to provide a smooth exterior so that the device is natural to use both horizontally and vertically. A simple re-set spring provides a smooth re-set action as the handle is raised. A staple track includes enlargement features to fit a larger staple pusher spring.

13 Claims, 13 Drawing Sheets

U.S. PATENT DOCUMENTS

| | | | | | |
|---|---|---|---|---|---|
| 4,156,499 | A | | 5/1979 | Frank | |
| 4,206,863 | A | | 6/1980 | Savino | |
| 4,463,890 | A | | 8/1984 | Ruskin | |
| 4,506,819 | A | * | 3/1985 | Rand | 227/120 |
| 4,546,909 | A | | 10/1985 | Ebihara | |
| 4,598,852 | A | | 7/1986 | Olesen | |
| 4,666,075 | A | | 5/1987 | Olesen | |
| 4,795,073 | A | | 1/1989 | Yamamoto et al. | |
| 4,811,884 | A | | 3/1989 | Sato | |
| 4,878,608 | A | * | 11/1989 | Mitsuhashi | 227/120 |
| 5,004,142 | A | | 4/1991 | Olesen | |
| 5,027,994 | A | * | 7/1991 | Lee | 227/120 |
| 5,356,063 | A | | 10/1994 | Perez | |
| 5,699,949 | A | | 12/1997 | Marks | |
| 5,715,982 | A | | 2/1998 | Adachi | |
| 5,816,470 | A | | 10/1998 | Plato et al. | |
| D413,239 | S | | 8/1999 | Lovegrove et al. | |
| 5,931,364 | A | | 8/1999 | Dennis | |
| 5,979,734 | A | * | 11/1999 | Chang | 227/76 |
| 5,979,736 | A | | 11/1999 | Edeholt | |
| 5,988,478 | A | | 11/1999 | Marks | |
| D429,453 | S | * | 8/2000 | Imboden et al. | D8/50 |
| 6,145,728 | A | | 11/2000 | Marks | |
| 6,152,347 | A | * | 11/2000 | Wilson et al. | 227/134 |
| D437,754 | S | | 2/2001 | Jacquet | |
| 6,318,619 | B1 | * | 11/2001 | Lee | 227/134 |
| 6,918,525 | B2 | | 7/2005 | Marks | |

FOREIGN PATENT DOCUMENTS

| | | | |
|---|---|---|---|
| DE | 19712849 | A1 | 10/1998 |
| DE | 10138447 | A1 | 7/2003 |
| DE | 10225816 | A1 | 1/2004 |
| GB | 2 032 327 | A | 5/1980 |
| GB | 2 229 129 | A | 9/1990 |

* cited by examiner 42
43
44
46
48

103
108
102
100

134
131
130
138

74a
74
72
70

185
300
81
87
82
89
85
62
180
84
80
65
62

185
300
87
81
82
85
180

400
185
180
80
85
145
142
144
300
81

92
90
94

SPRING ENERGIZED DESKTOP STAPLER

CROSS-REFERENCE TO RELATED APPLICATIONS

This is a divisional application of application Ser. No. 11/065,781, filed Feb. 24, 2005, which is a continuation Ser. No. 10/443,854 filed May 23, 2003 of U.S. Pat. No. 6,918,525 (Marks), all of whose contents are hereby incorporated by reference in their entirety.

FIELD OF THE INVENTION

The present invention relates to desktop staplers. More precisely the present invention discloses improvements to a spring-actuated stapler.

BACKGROUND OF THE INVENTION

In a common desktop stapler a striker is linked directly to a handle so that pressing the handle ejects a staple out and through a stack of papers. Three distinct forces must be overcome: breaking off the staple from the rack of staples, piercing the papers, and folding the staple legs behind the papers. As the staple moves through the cycle there are force peaks and force lows. The result is a jerky experience as the user forces the handle down. The handle resists, suddenly gives way, and then resists again. Even though the peak forces are for short durations, they define the difficulty of using a stapler. Empirical information suggest that a conventional stapler requires peak forces of 15 to 30 pounds, depending on the number of paper sheets to be fastened.

It is desirable to limit the peak force required. An effective way to do this is to accumulate the total energy needed to install the staple and then release that energy all at once by striking the staple in an impact blow. This is a type of action commonly used in staple gun tackers. A handle is pressed through a range of motion causing a spring to store energy. The stored energy is suddenly released at a predetermined handle position. A striker linked to the spring ejects and installs a staple released at a predetermined handle position. A striker linked to the spring ejects and installs a staple.

An important advantage of using stored energy to install a staple is that the handle end need not be directly linked to the striker. In a common direct acting desktop stapler the handle front end moves exactly as the staple moves. This means that, for example, 15 lbs. to force a striker, thus a staple, to move 1 mm requires 15 lbs. to move the handle that same 1 mm. If the driving energy is stored, then the handle can be de-linked from the striker. The handle can move more than the striker moves to provide enhanced leverage. For example, the handle, where it is pressed near its front end, may move downward one inch as the spring is deflected, while the striker moves just ½ inch when the spring is released. According to the preceding discussion, force in stapling can be reduced through two ways. First, spring stored energy allows removal of force peaks by averaging forces over a full handle motion. Second, the energy can be stored through a leveraged system.

A stapler must have a method for adding staples to a staple track. In a common direct acting stapler the striker has a rest position immediately above the staple to be ejected. The track may move outward from the front of the stapler to expose a staple loading area since the striker does not obstruct such motion. Or the handle may be linked to a staple pusher whereby pivoting the handle away from the track causes the pusher to retract while the track becomes exposed.

In a practical spring actuated stapler these two common loading systems are not easily provided. The striker rests in its down position just in front of the staple rack. It is not possible to slide the track out past the obstruction created by the striker. Further, since there is an energy storage mechanism linking the striker to the handle in the spring-actuated stapler, it would require a complex design to provide for exposing the staple track by pulling the handle away from the track. An alternate staple loading design is needed.

Among the prior art is UK Patent Application GB 2 229 129A (Chang). A spring actuated heavy-duty desktop stapler includes a two piece molded housing with a double torsion (two coil) power spring. A lever has a "U" channel section, and engages an extended handle by means of a roller linkage.

German Patent No. DE 28 56 621 (Ghibely) shows a staple gun that uses a similar mechanism to the above Chang '129 reference, but as a staple gun tacker, without a base or a forward handle linked to the lever.

U.S. Pat. No. 4,463,890 (Ruskin) discloses a standard style desktop stapler with a spring-actuated driver. The striker has a raised rest position, above the staples as in typical direct action staplers. Base 10 overhangs rubber footpads under the base at the distal front and rear ends of base 10.

U.S. Pat. No. 2,271,479 (Gambao) shows a stapler with footpads slightly more closely integrated with the base. The front footpad angles upward and forward to meet the lower edge of the base, leaving a notch under the base.

UK Patent Application GB 2 032 327A (Barriendos) shows re-set spring 12 attached to lever 3 rearward of lever pivot 4.

U.S. Pat. No. 5,988,478 (Marks) and U.S. Pat. No. 6,145,728 (Marks) to the present inventor, show forward action staple guns. In both references, the lever has a "U" channel section that partially surrounds the power spring from above. In '728 lever 60 engages striker 80 by two opposed openings 83. Power spring 70 fits into striker opening 87 between the opposed lever openings. In Marks '478, the handle is pivoted to the body by arcuate extensions 32 surrounding post 12.

U.S. Design Pat. No. Des. 186,342 (Marano), U.S. Pat. No. Des. 243,148 (Levin), U.S. Pat. No. Des. 413,239 (Lovegrove), and U.S. Pat. No. D437,754 (Jacquet), show various base designs. A short center portion of the base is actually or visually raised in these designs.

U.S. Pat. No. 5,699,949 (Marks) to the present inventor shows a further forward action staple gun. A staple track is at the bottom of the device, behind the numeral 50 in FIG. 1, formed as an upright "U" metal channel. A staple track guiding tab of: the track is seen just to the left and above the numeral 5 in FIG. 1. An opening is seen in the side of the track from which the tab has been formed. A pusher spring resembling a cross hatch shows through this opening in FIG. 1. The tab is made from a cut out portion of the side of the "U" channel.

U.S. Pat. No. 2,218,794 (Kilbride) shows a spacer spring 39 that serves a function to releasably limit upward motion of the body through a snap fit. Elongated "ears or bearings 11" position the body laterally above the base in a conventional way by contact between the body sides and the elongated bearings 11. Spring 39 includes various out-of-plane bends to allow it to change length as the body closes against the base. It is therefore not stiff in the lateral direction. Further, rivet 38 does not provide substantial lateral stiffness to spring 39.

U.S. Pat. No. 4,546,909 (Ebihara) shows a stapler with a spacer spring a3 or a4 formed as a "punched out" element.

U.S. Pat. No. 4,795,073 (Yamamoto) shows a spacer spring 19 that is apparently molded as part of the base.

U.S. Pat. No. 4,811,884 (Sato) shows a base with a rearward attachment to the body. Groove 107 engages tab 108 to hold the base in the fully open position, col. 9, lines 5-13.

SUMMARY OF THE INVENTION

In the present invention a desktop stapler includes improvements to increase ease of use and modes of use. A spring is linked to a striker so that when the striker is raised and suddenly released the stored energy of the spring drives a staple through a stack of papers to be fastened together. A handle is pressed to raise the striker and store energy in the spring. Improvements of the invention include: a very compact mechanism to maintain a conventional looking size of the stapler, a smooth re-set action as the handle is raised, a simplified handle pivot connection and assembly method, a spring to raise the stapler body away from the base where the spring is integrated into a base cover plate, the base cover plate further including a staple forming anvil, a press fitted connection between the body and the base, a novel method to accurately position the body front end over the anvil, a location for a staple loading track that is convenient and compatible with a striker that maintains a lowered rest position, a rear distal end of the body resiliently engages a rib of the base to create a releasable detent holding the body in a maximum up position from the bias of the body raising spring, and a base that is raised along the majority of its length and is convex in its underside to facilitate lifting the stapler off a table. A further operational mode allows that the stapler rests on a desk in a front down vertical position so that it may be most easily lifted up for use.

A staple loading system includes a track pull element that is normally hidden from view. Pivoting the body up from and rearward of the base exposes the track pull for operation.

An advantage of the present invention is that the low operating force makes it easy to use with an extended hand on a desk. It is even practical to press by fingertips.

DETAILED DESCRIPTION OF THE PREFERRED EMBODIMENTS

Figure 2:
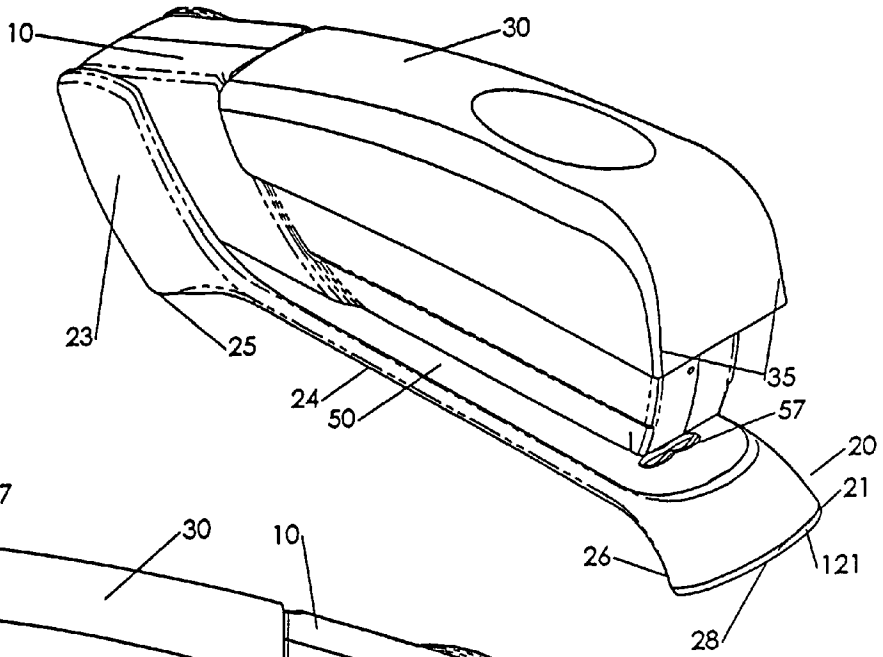
FIG. 2 is an upper front right side view of the stapler of FIG. 1.
Figure 1:
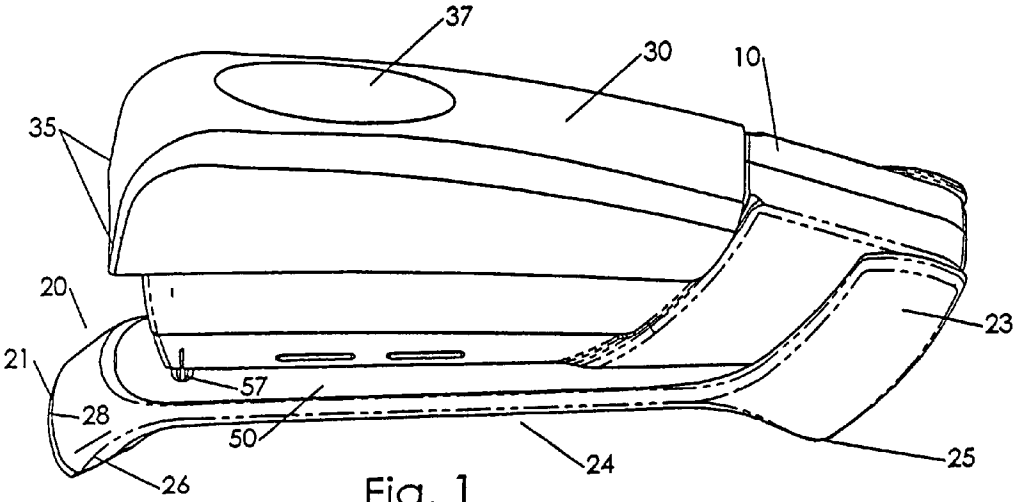
FIG. 1 is an upper left side view of the stapler of the invention.
Figure 8:
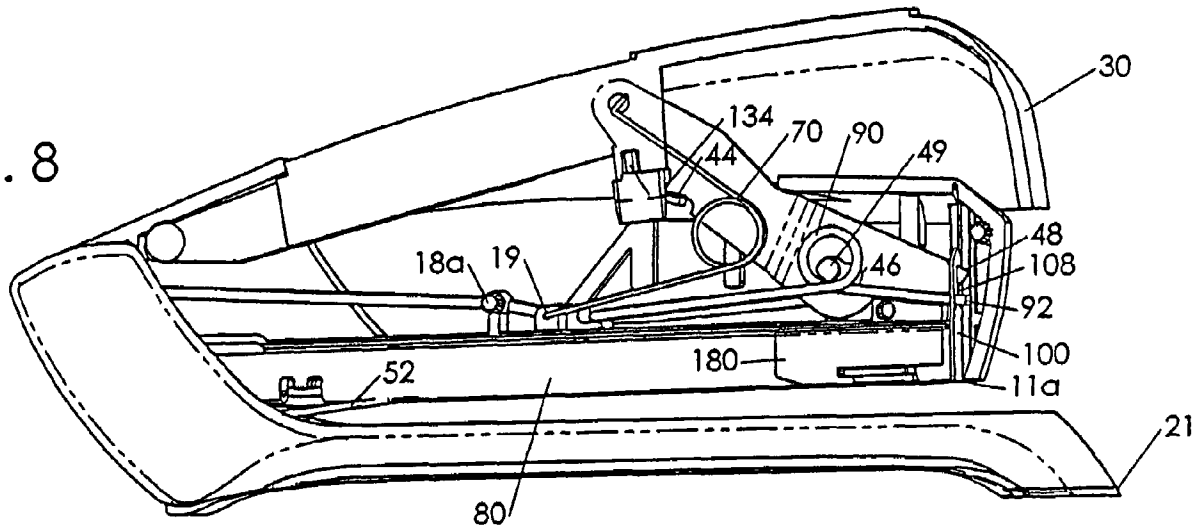
FIG. 8 is a side view of the stapler of FIG. 6.
Figure 20:
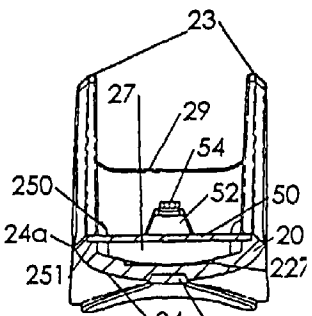
FIG. 20 is a partial cross-sectional lengthwise view of the base of FIG. 19.

FIGS. 1 and 2 show a desktop stapler according to the invention in a substantially horizontal orientation, as it would sit upon a desktop. Base 20 can be seen with a raised elongated central under portion or surface 24 and front and rear foot sections 25 and 26. Base 20 may be made from plastic such as glass filled polypropylene, polycarbonate, etc. Body 10 includes a left half, FIG. 25, and a right half, FIG. 24. Body 10 may be made from high strength low friction nylon. However, other materials may be used such as other plastics or die cast metal. Die cast metal may be desirable if higher weight is needed for design preference. Cover plate 50 encloses cavity 27 of base 20, FIG. 20 to define a central top surface of base 20. Anvil 57 is formed into the material of cover plate 50. Alternatively, anvil 57 is a separate and possibly movable steel element from cover plate 50. In this case cover plate 50 may be of a plastic or other non-ferrous material. Pivotable handle 30 fits to housing 10. Optional inset 37 includes decorative or instructive graphic information. Handle 30 includes a front face bounded on two sides by corners 35. Corners 35 gradually become more rounded toward the top of the handle, remaining sharp at least to the position of contact with surface 200 in FIGS. 3 and 4. Sidewalls 23 of base 20 surround housing 10 to an upper rear of housing 10. The front end of base 20 includes a top face of front foot section 26. This top face is sloped down to a first edge 21 of the rigid material of base 20. The front face of footpad 121 continues to slope down and forward to a lowermost level of the stapler, edge 121*a*, FIG. 8. Footpad 121 is part of rubber or elastomer overmold 120, FIG. 4. Footpads 121 and 122 extend across the width of foot sections 25 and 26, and are connected by an elongated narrow central section of overmold 120. Overmold 120 thus forms an hourglass shape with a long neck section, FIG. 4. The exposed rigid material of underside 24 is relatively slippery so that fingers may easily slide under base 20. The narrow strip of overmold 120 along the center of underside 24 helps a user keep a grip on the stapler after the fingers are in position around the stapler.

Figure 14:
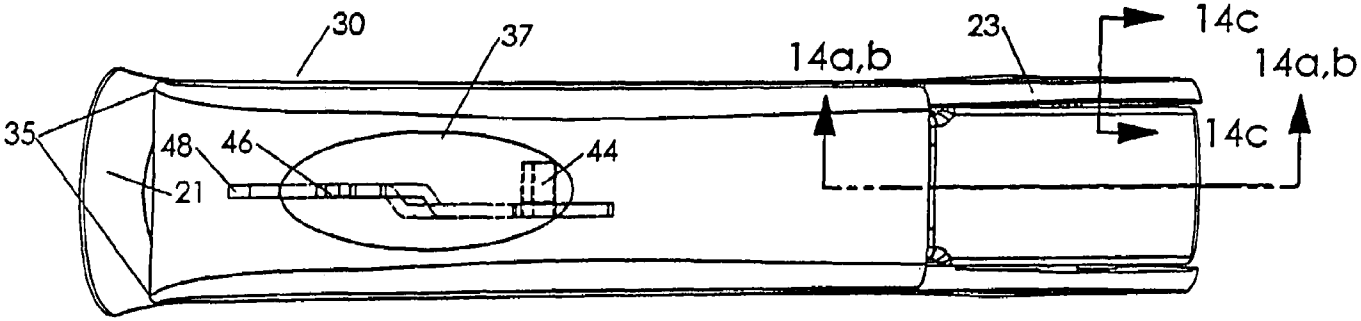
FIG. 14 is a top view of the stapler, a lever in hidden view.

Handle 30 between corners 35 may be straight or concave. It is slightly concave in at least one portion as seen in FIG. 14. The front face defined by corners 35 allows the stapler to be stable in a vertical position on a desk, FIGS. 3 and 4. Surface 200 represents such a desk. The vertical position is most convenient for users that wish to normally lift the stapler for use by squeezing. The convex cross-sectional shape of the length of under portion 24, FIG. 20, makes squeezing especially comfortable. Other shapes could be used such as segments that approximate a convex shape. Edge 24*a*, FIG. 20, defines a highly raised edge of the central portion of the base, near the level of the top of cover plate 50, so that fingers can easily grip under the stapler. This highly raised edge extends along each side of the base effectively making the bottom of base 20 much higher off a surface than it would be if the entire underside were at its lowest level, the position of centrally aligned overmold 120 in FIG. 20. It is desirable to keep the level of cover plate 50 on base 20 as low as possible so that papers do not need to be raised too high for stapling. At the same time a limitation to raising the level of under portion 24 is that the thickness of base 20 must be sufficient to maintain adequate stiffness of the base. Therefore, using a low center with higher edges 24*a*, joined by a convex cross-sectional shape below with a flat top provides a low but thick base comprising an approximate "D" shape that is easy to grip under. Foot sections 25 and 26 comprise a short portion of the length of base 20, being separated by a long straight portion including convex underside 24. In fact, foot section 25 at rear footpad 122 contacts a horizontal surface at just two points, 122*a*, FIGS. 7 and 18. Edge 24*a* extends 30 from near a forward most, lowest point of base 20, near callout 26, FIG. 1, up to a long straight segment near the level of cover plate 50, and down to a rear most, lowest point of base 20, near callout 25, FIG. 1.

Figure 4:
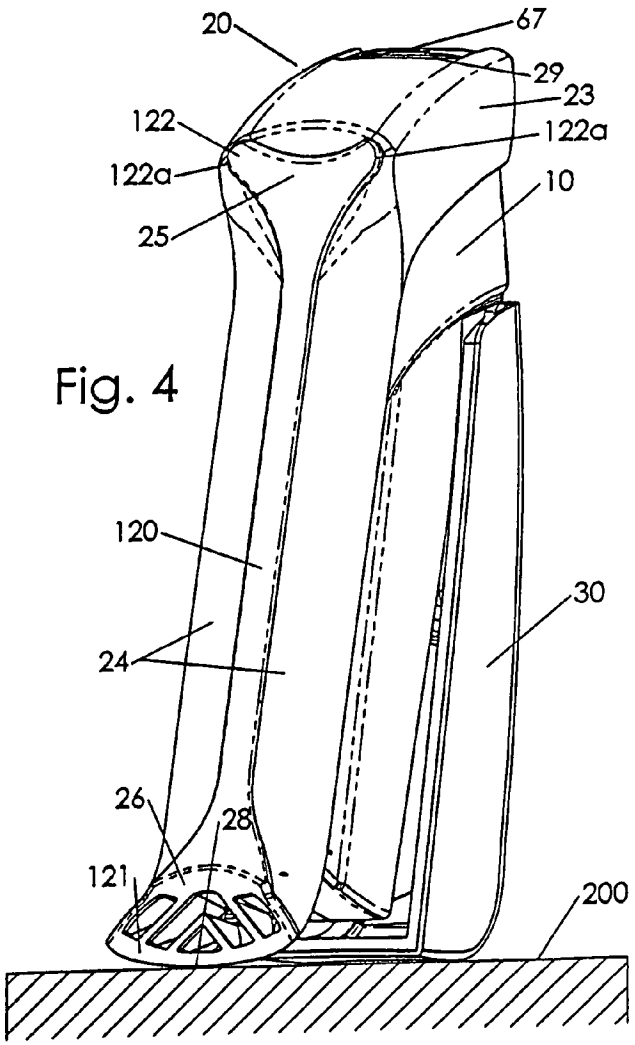
FIG. 4 is a bottom right side view of the stapler of FIG. 3.
Figure 3:
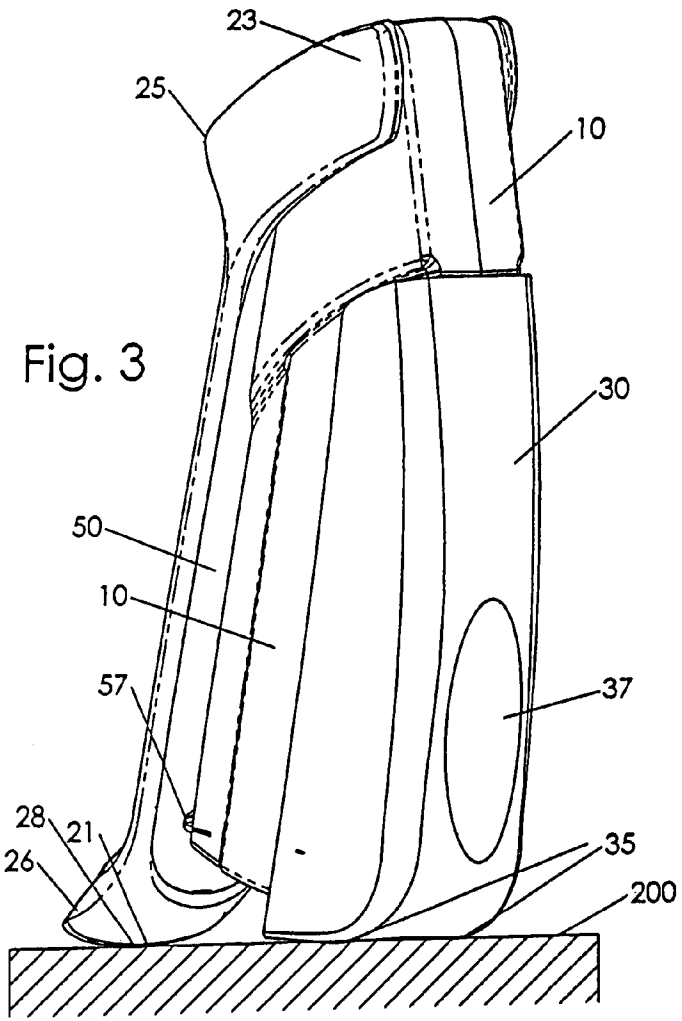
FIG. 3 is an upper right side view of the stapler in a vertical orientation.

Three points support the stapler in the vertical position, the two corners 35, and base front end 28, preferably at the central forward edge of footpad 121. As a design choice front end 28 may be flat, with respect to a top view, to provide a longer support surface. However, in the illustrated embodiment most of the weight in the vertical position is supported at the handle, so corners 35 provide good support. As seen in FIGS. 3 and 4, corners 35 do not need to contact surface 200 at a lower most edge, but rather the handle front may be shaped so that contact with surface 200 is at a handle surface more to the right in FIGS. 3 and 4.

Figure 7:
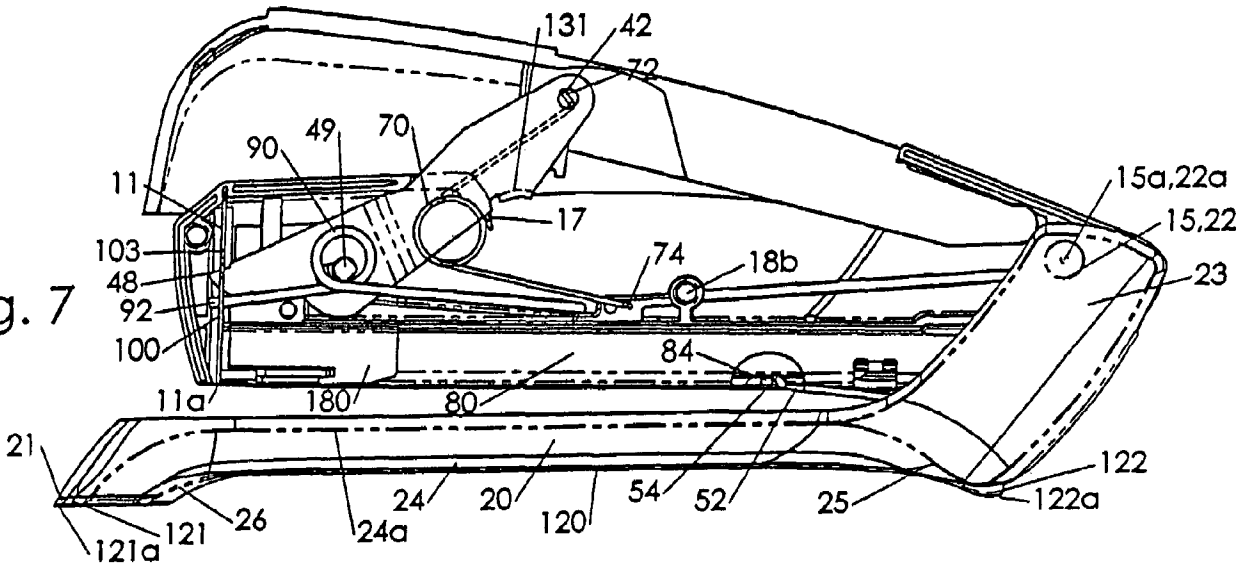
FIG. 7 is a side view of the stapler of FIG. 5.
Figure 18:
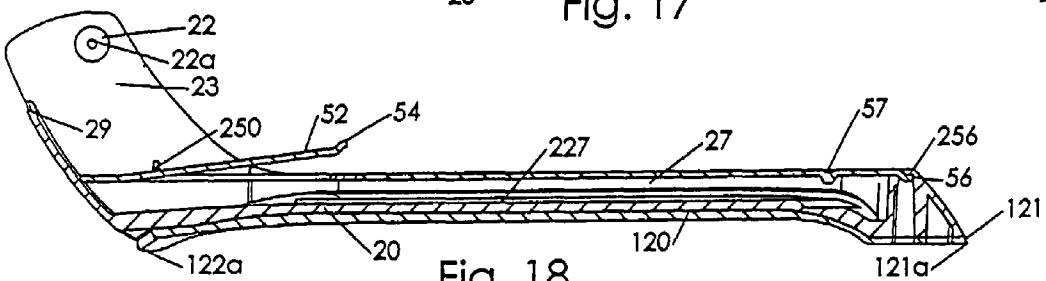
FIG. 18 is a partial cross-sectional side view of the base of FIG. 17, with a cover plate assembled to the base.

The forward edge of footpad 121 extends to sharp edge 121*a*, FIGS. 7 and 18. In each of the horizontal position of FIG. 1 and the vertical position of FIG. 3 this edge of soft material touches a desk surface. The front face of footpad 121 is aligned with edge 21. Optionally, edge 21 could be stepped behind the front face of footpad 121. Combined with the downward sloped base front including rigid edge 21, a continuous ramp is provided to lift a paper sheet off a table and guide the sheet up onto cover plate 50. In the horizontal position there is no gap or undercut to catch a sheet under edge 121*a* of base 20. Edge 21 should not be stepped forward since the resulting ledge would catch a paper sheet sliding up footpad 121 of the ramp. Overmold 120 includes front footpad 121 and rear footpad 122.

Figure 5:
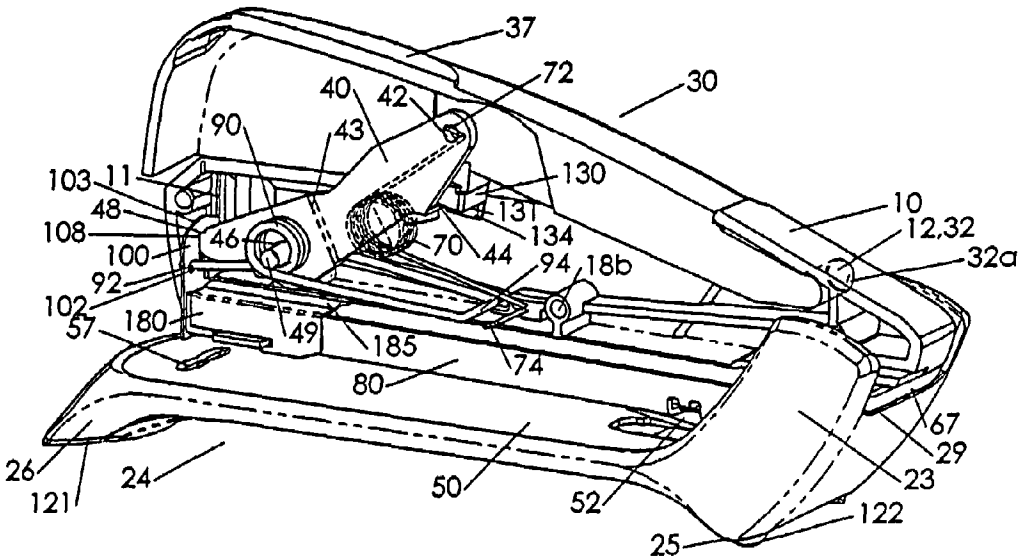
FIG. 5 is a rear-left side view of the stapler with the left housing half removed, and the handle partly in section.
Figure 6:
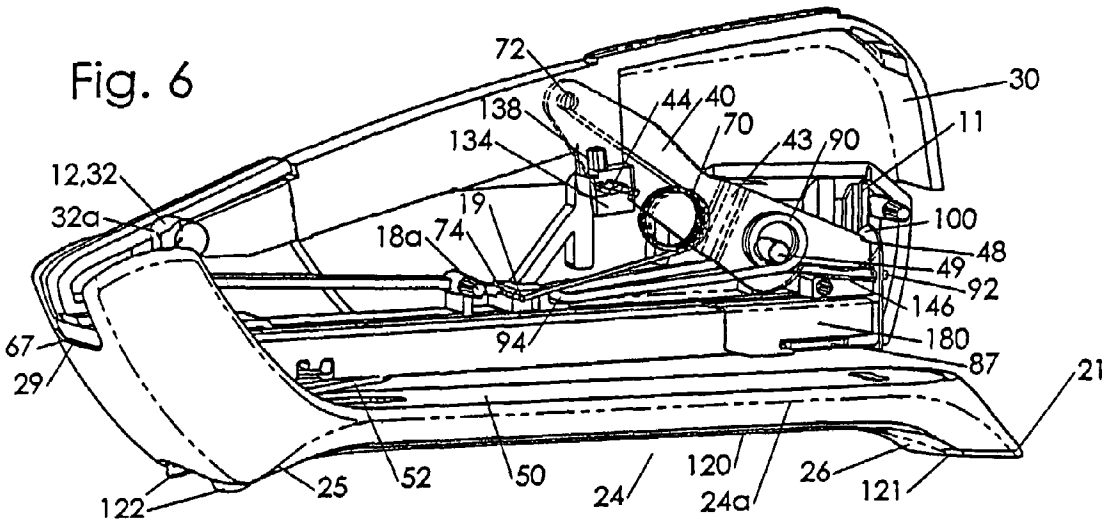
FIG. 6 is a rear-right side view of the stapler of FIG. 5, with the right housing half removed, and the handle partly in cross-section.
Figure 21:
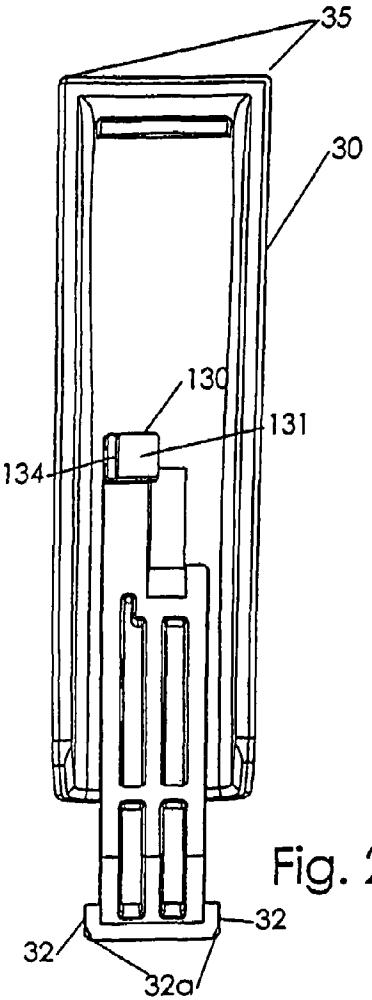
FIG. 21 is a bottom view of a stapler handle.

FIGS. 5 and 6 show internal elements of the stapler of the invention in a rest position. See also FIGS. 21 to 32. In FIG. 5 the left housing half is removed to expose the interior, while in opposite view FIG. 6, the right housing half is removed. In each view the respective side of handle 30 is cut away. Handle 30 pivots about bosses 32, FIG. 21, within recess 12 of body 10, FIGS. 24 and 25. Lever 40 pivots about pin 49 at slot 46, FIG. 27. Pin 49 fits within cavity 149 of housing 10.

To best fit the components of the stapler in a compact body shape, a single relatively thick plate lever 40 is used rather than a thinner steel inverted U channel lever design. Lever front end 48 thus extends through single central slot 108 under a tall center portion of striker 100, FIG. 8. Lever 40 includes a centrally aligned front portion and a rear portion out of plane from the front portion, defined at bend 43, FIG. 14. The rear portion is to one side in body 10, into the page in FIGS. 6 and 8, to allow clearance for the coil of re-set spring 70. Tab 44 extends back across the centerline of the body, out of the page in FIGS. 6 and 8. Tab 44 provides an engagement surface upon which handle 30 can press.

Figure 22:
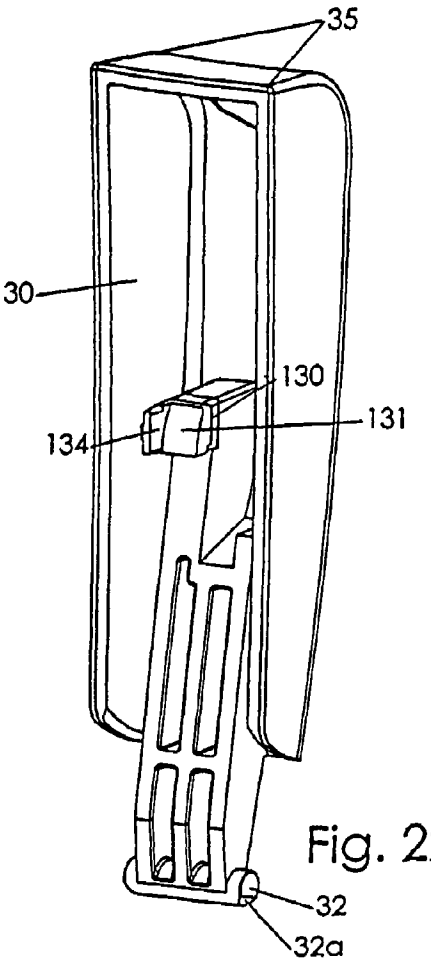
FIG. 22 is a bottom-left view of the handle of FIG. 21.

Preferably handle 30 presses tab 44 through a low friction linkage. In FIG. 22 slip link 130 is shown attached to handle 30. Stem 138, FIG. 8, extends by a friction fit into a cavity of handle 30 to secure slip link 130 to the handle. In normal use tab 44 presses upward so that slip link 130 cannot fall out of position. Slip link 130 is made from a low friction material such as Teflon or acetal such as Delrin 100ST. Optionally, handle 30 could be made entirely from such a low friction material, but it would be much more costly to produce than if only slip link 130 is of the low friction resin while handle 30 is of olefin, ABS or other common structural plastic. Alternatively, a roller or a pivotable arm could be attached to either of handle 30 or lever 40 to provide a low friction linkage between the elements. Slip link 130 includes guide wall 134 to help position handle 30 within housing 10. Curved surface 131 presses tab 44.

Striker 100 is fitted along two edges in guide channels 11 of housing 10, FIG. 5. The location where slip link 130 presses tab 44 is substantially coplanar with slot 46 and lever front end 48. Lever 40 is flat in the area of slot 46. In FIG. 14 this is approximately the plane of section cuts 14*a, b*. This alignment is important with the single thickness lever 40 to prevent twisting forces upon lever 40. Non-aligned linkages could cause the lever to twist and bind within body 10 since it is not inherently stable like a less compact U channel.

Power spring 90 stores energy for installing staples. Spring 90 is linked to handle 30 through lever 40 and striker 100. Lever 40 pivots about pin 49 at slot 46 to raise striker 100 at lever front distal end 48, FIGS. 9 and 10. Rising striker 100 in turn deflects the front end of spring 90 up by linkage to the spring at openings 102, FIG. 5. In the illustrated embodiment handle 30 moves downward at its front end about 0.9 inch. This is approximately double that possible with a direct action stapler where the handle is directly linked to the striker. The increased handle travel provides additional leverage to deflect spring 90, thus allowing reduced handle force. Spring 90 is preferably a double torsion spring, with co-axial helical coils to each side of lever 40, with the coils linked at rear end 94; lever 40 passes between the coils. Lever 40 pivots about an axis defined at pin 49. Spring 90 pivots about an immediately higher axis defined by sleeve 148, FIGS. 24 and 25. Preferably sleeve 148 of housing 10 surrounds pin 49 to both position pin 49 and give low friction support to the interior of the coil of spring 90, FIGS. 9, 24 and 25. Sleeve 148 is cylindrical or equivalent in function to define an axis of pivoting for spring 90. A large low friction support surface increases the efficiency and cycle life of spring 90 as the spring wire slides against the sleeve. If the spring rubs on a small steel pin rather than a larger molded plastic surface, the spring will wear quickly. As shown, sleeve 148 defines an axis that is slightly off center from pin cavity 149, FIG. 24, with the lower wall of sleeve 148 being thin to the limit of what can be reliably molded. This allows spring 90 to pivot about the highest possible position, nearly but not precisely co-axial with the lever pivot defined by pin cavity 149. A low position of the spring coil would cause the angle between spring ends 92 and striker 100 to become large at the striker's upper most position of FIGS. 9 and 10. A large angle would force the striker forward causing excess friction between the striker, spring, and channels 11.

Figure 9:
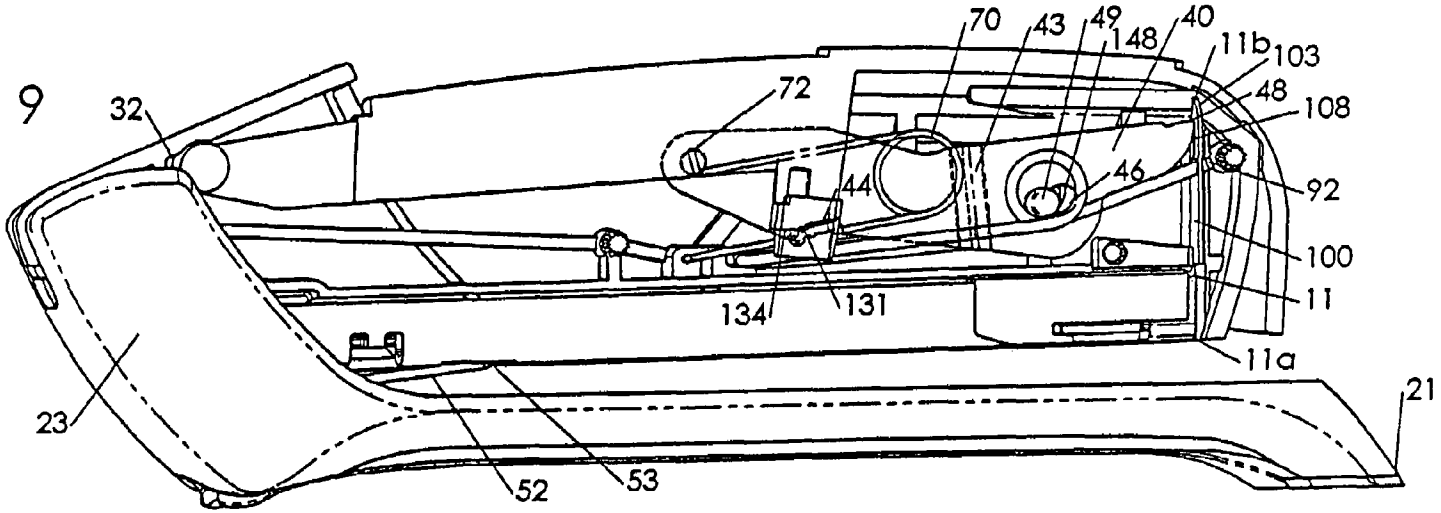
FIG. 9 is the stapler of FIG. 8, with the mechanism in a pre-release position.
Figure 10:
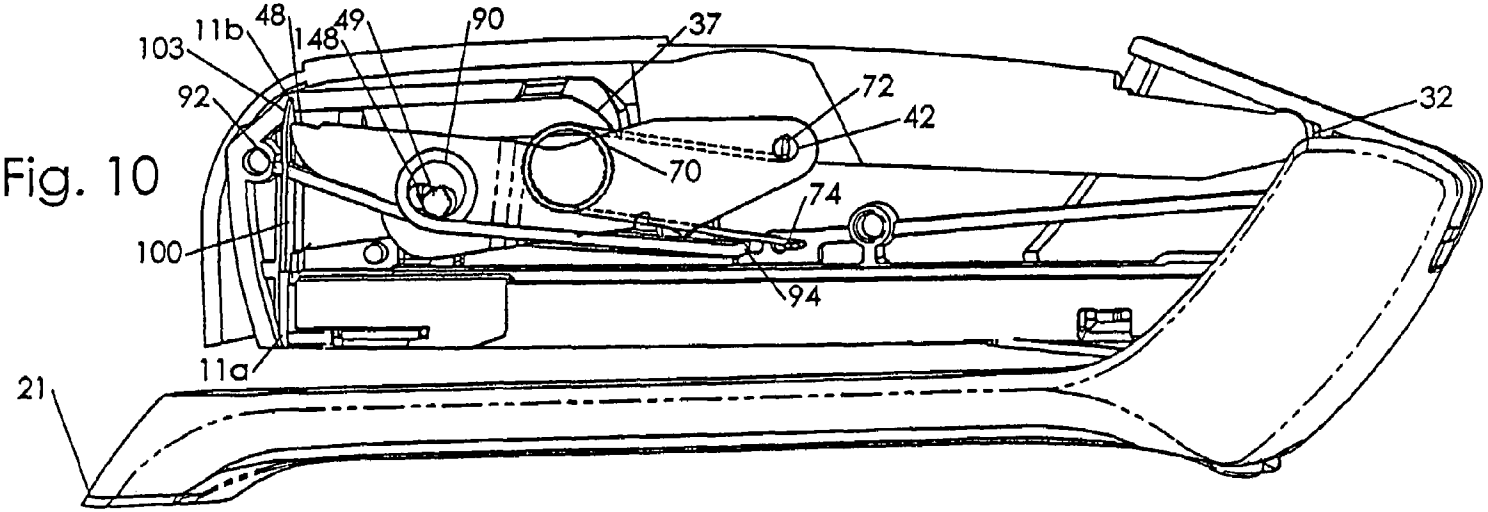
FIG. 10 is the stapler of FIG. 7, with the mechanism in a pre-release position.

FIGS. 9 and 10 show a pre-release position of the stapler mechanism. Lever front end 48 is just out of the plane defined by striker 100, no longer engaged with slot 108. Striker 100 is free to accelerate downward under the stored energy of spring 90, to install a staple. Note that the handle interior is very near to top edge 103 of striker 100. Top edge 103 is adjacent to upper end 11*b* of striker channel 11. Handle 30, shown in cut away, is therefore in a lower most possible position. To fit lever 40, spring 90 and striker 100 in a reasonably sized device resembling a desktop stapler requires a very compact design. A limitation is that handle 30 should be able to fully lower against body 10 as defined by the striker top most position. The upper surface of handle 30 is strongly rounded to make the handle comfortable to grip and not appear large. The top of body 10 is similarly rounded, being tallest at the center of its thickness. Striker 100 is then also peaked at top edge 103 to provide the maximum possible striker material within body 10 that is compatible with the striker uppermost position. Lever end 48 can therefore nearly approach the very top of the interior of rounded body 10 in an uppermost position. Two ends 92 of the double torsion spring fit into openings 102 below and to each side of slot 108. Lever 40 is "nested" within the spring, between the coils of spring 90, so that the assembly of the lever and spring are vertically compact. Pin 49 extends through both slot 46 of the lever and the coil of spring 90.

As handle 30 is forced downward to the position of FIGS. 9 and 10, slip link 130 presses tab 44, in a sliding relation that accommodates the arcing motion of the handle about boss 32 and lever 40 about pin 49. The surface of tab 44 is convex such that the contact point between curved surface 131 of slip link 130 and tab 44 includes a radial force component toward pin 49. See tab 44 where slip link 130 is cut away in FIG. 8. A perfectly tangential contact would not produce any force toward pin 49, only around pin 49. A radial component produces a cam action that exaggerates the motion of lever 40 with respect to motion of handle 30. The extra lever motion shows as additional sliding of tab 44 under curved surface 131 beyond that which would result just from the respective arcing of the lever and handle. The cam action functions as long as there is some inherent sliding at the contact point, where the sliding is reducing the combined distance from: boss 32—to the contact point at tab 44—to pin 49.

When boss 32, the contact point, and pin 49 are aligned, there is a neutral condition with no sliding. In FIGS. 9 and 10 the handle and lever positions are just past this neutral condition. The contact point has moved forward to a different position of convex tab 44. The force on tab 44 from curved surface 131 is nearly entirely tangential about pin 49.

The effect of the above discussion of the contact point is a varying leverage action of the handle upon the lever. The handle moves the lever quickly with low leverage at the start of the stroke, FIGS. 5 to 8. At the end of the stroke, FIGS. 9 and 10, the leverage of handle 30 is relatively higher upon lever 40. At the same time the force required to deflect spring 90 increases as striker 100 is lifted toward the position of FIGS. 9 and 10. Since the leverage provided by the handle increases through the stroke, the net force required to operate the handle is relatively constant, with no hard to overcome peak at the end from a highly deflected spring 90.

Figure 11:
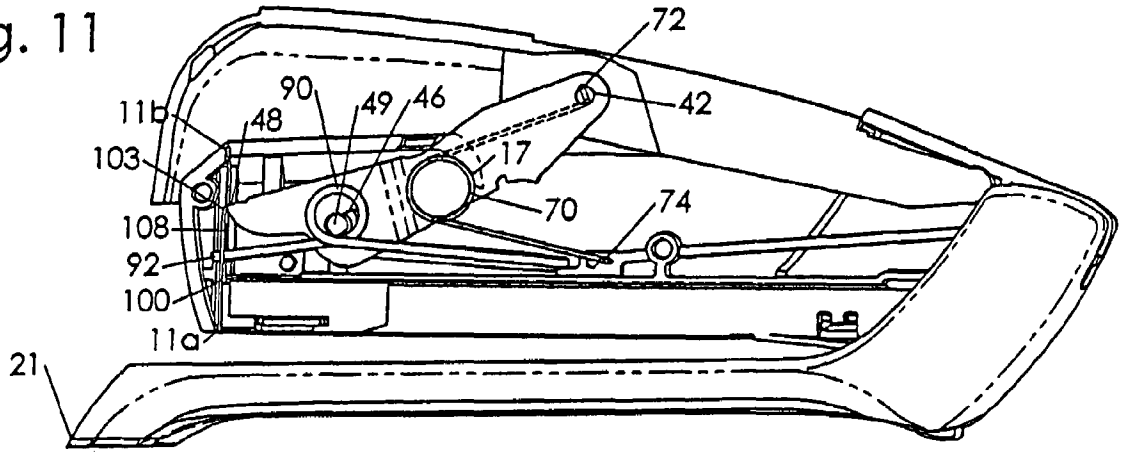
FIG. 11 is the stapler of FIG. 7, with the mechanism in a re-set stroke.

FIG. 11 shows a re-set position of the stapler intermediate between the rest position and the pre-release position. This condition occurs as handle 30 is lifted after ejection of a staple out of staple ejection slot 11*a*. Re-set spring 70 is biased to rotate lever 40 so that lever front end 48 moves down into alignment with slot 108 of the striker during a re-set stroke. The lever rear end including tab 44 moves upward as lever 40 pivots about pin 49. To provide a smooth re-set action it is necessary that lever end 48 first moves down to top edge 103 of the striker, then secondly slides down past top edge 103 of striker 100 with little resistance. Therefore, the lever should not be biased forward in this part of the re-set stroke. To prevent a forward or rearward bias upon lever 40, re-set spring end 72 is positioned substantially directly above spring end 74 in body 10 during most of the re-set stroke. Re-set spring end 72 presses generally upward at hole 42 of lever 40. However, at the end of the re-set stroke a forward bias is required upon lever 40 to cause lever end 48 to move into and engage striker slot 108 in a third and final step of the re-set action. For this purpose, body 10 includes a rib 17 extending across a width of the body toward the out-of-plane, or rear, portion of the lever. In the illustrated embodiment, rib 17 is an element of the right half of housing 10, FIG. 24. However, rib 17 could be attached to or part of the left half, FIG. 25, or other part of the stapler. As lever 40 rises at its rear end the coil of spring 70 also moves upward. The coil also moves rearward as spring ends 72 and 74 move apart because of the increasing angle between the arms of spring 70. At a predetermined position of the re-set stroke the coil contacts rib 17 and can no longer move up or rearward. The coil then pressed upward against rib 17, slightly urged forward by the angle of rib 17, while spring end 72 is biased to arc up and forward about a center defined approximately by the axis of the spring coil. The forward element of this bias causes lever 40 to slide forward upon pin 49 about slot 46. Lever end 48 moves into slot 108 of striker 100.

In the re-set action it is desirable to maintain a downward bias upon pin 49 by lever 40 so that there is no take-up or "rattle" within slot 46 as the next power stroke begins. For example, if a re-set spring causes an upward force at pin 49, pin 49 will press the bottom edge of slot 46. As the power stroke begins slot 46 will press pin 49 at the opposing upper slot edge. The lever will unproductively move as slot 46 adjusts about pin 49. To prevent this wasted motion re-set spring upper end 72 is fitted in lever hole 42, rearward of tab 44. Hence, as slip link 130 presses down on tab 44, and spring end 72 presses up on the rear end of the lever at hole 42, all points on the lever forward of tab 44, including slot 46, are biased downward. A tab notch or other engaging feature of lever 40 may serve the function of hole 42.

Re-set spring 70 includes features at each end to hold the spring in place. During assembly lower re-set spring end 74 is normally installed first into hole 19 of the left half of housing 10, FIG. 25. Hole 19 is larger in diameter than the wire of spring 70. Spring end 74 includes a short bent segment 74*a*, FIG. 30 such that the end 74 including 74*a* presses the wall of hole 19. This interference prevents the spring from falling out of hole 19 as the stapler is assembled. After assembly an opposing rib 174, FIGS. 11 and 24, normally holds spring end 74 in hole 19. Note that spring end 74 appears uncontained in FIG. 11, since the housing left half is not shown for clarity.

After brief use of the stapler, the distal end of segment 74*a* digs a circumferential partial groove in the wall of hole 19 as end 74 rotates in the axis defined by the hole. Then end 74 with segment 74*a* pivots with minimal resistance in hole 19. Spring upper end 72 includes a simple structure to hold it in position in hole 42. End 72 extends upward as it passes through hole 42, as best seen in FIG. 5. As spring 70 presses up within hole 42, it is drawn toward lever 40 because of the upward angle of end 72. To further secure the upper spring end from sliding out of hole 42 a rib of handle 30 extends behind spring end 72 in FIG. 5. This rib does not normally contact the spring except in the possible case of impact from dropping of the stapler.

During the re-set stroke handle 30 rotates upward as tab 44 presses handle 30 upward, through slip link 130, from the bias of re-set spring 70. Handle 30 rotates at recess 12 of body 10 about a boss 32 on each side of the handle. Body 10 preferably includes chamfers 13 aligned with bosses 32, FIGS. 24 and 25. Handle 30 may be assembled into body 10 by pressing the handle rearward into the body after all the internal components of the stapler are assembled but optionally before the two halves comprising body 10 are fully fastened together. The halves of the upper rear part of body 10 will slightly separate with assistance from chamfers 13 to allow bosses 32 to pass into recesses 12. A rear edge of bosses 32 may also be chamfered at chamfers 32*a*, FIG. 22. By assembling the handle after both housing halves are fitted together there is no concern that internal parts can fall out of position as the handle is moved into place. Optionally, handle 30 may include recesses to fit inward facing bosses in body 10. The assembly function would be equivalent.

Figure 13:
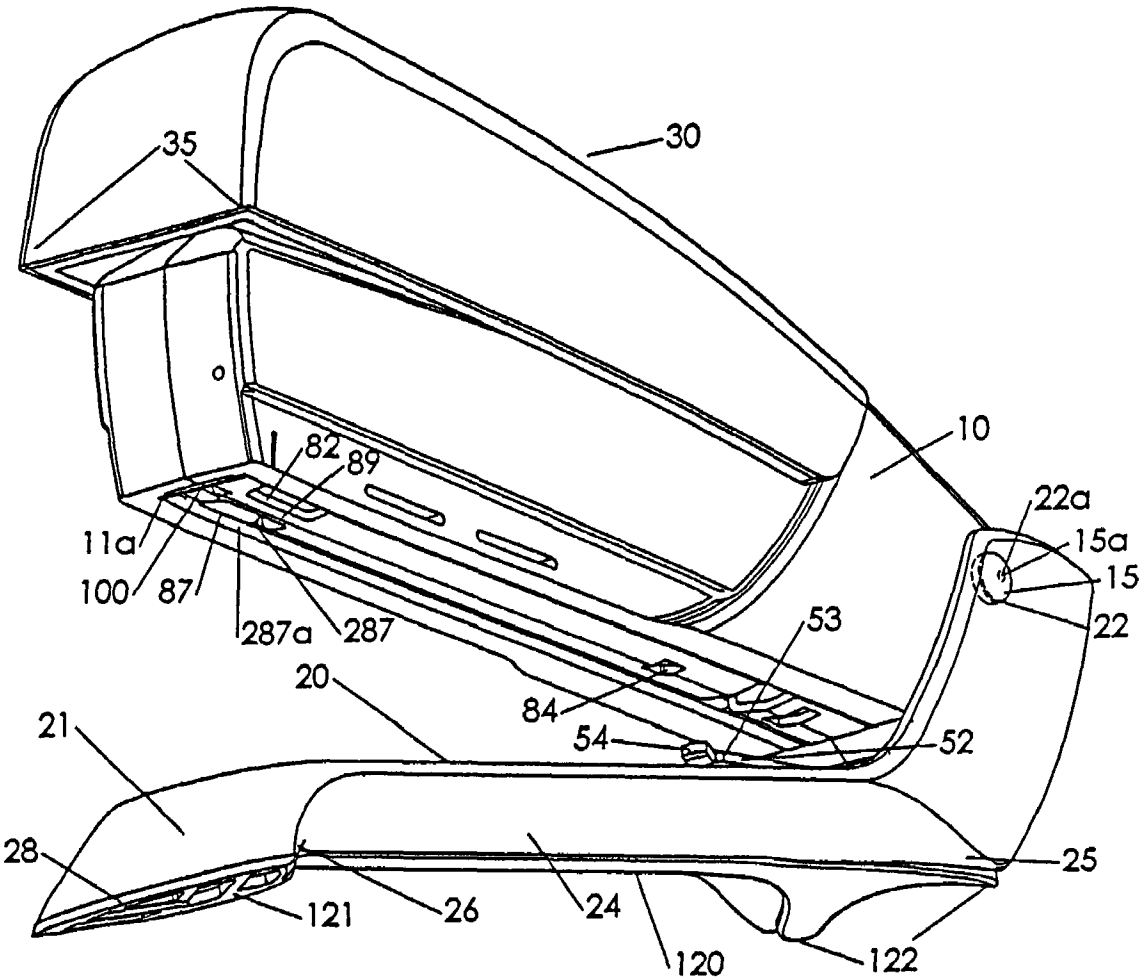
FIG. 13 is a front-left side view of the stapler, with the body partially raised.
Figure 19:
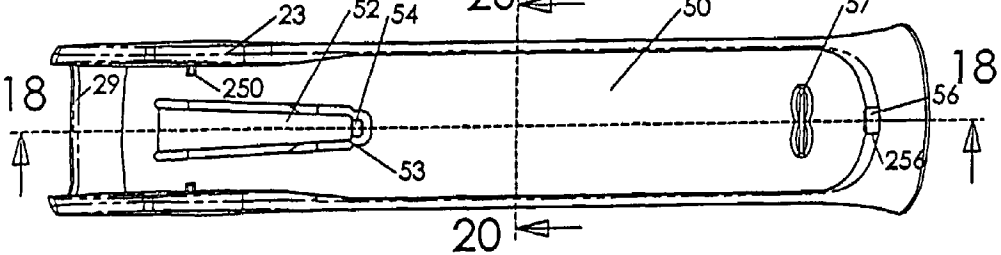
FIG. 19 is a top view of the base assembly of FIG. 18.
Figure 23:
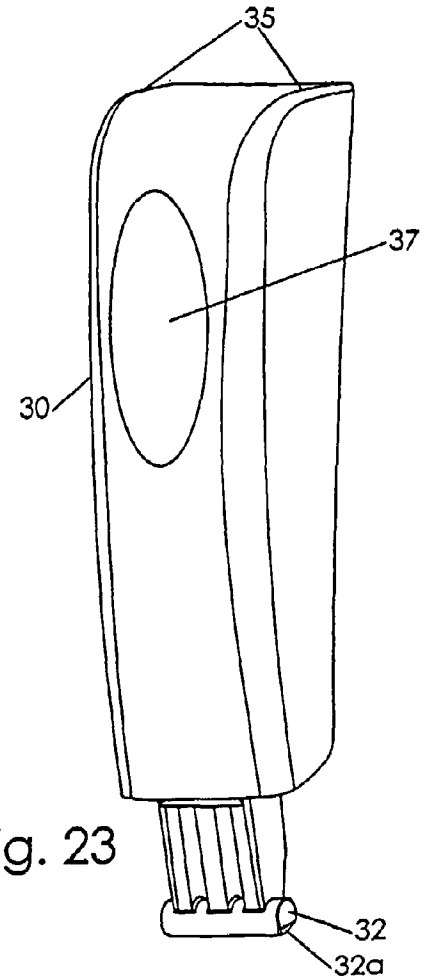
FIG. 23 is a top-right view of the handle of FIG. 21.

The stapler includes a normal closed position. In the closed position the body is substantially parallel and spaced from base 20, as shown in most of the figures of the complete assembly. FIGS. 7, 18 and 19 show spacer spring 52. Tab 54 is an offset feature at the distal end of the spring. The tab engages opening 84 of track 80. Shoulder 53 is a spring surface adjacent to tab 54. Shoulder 53 presses the bottom of track 80 while adjacent offset tab 54 protrudes into opening 84. Tab 54 will not necessarily contact any part of opening 84 or track 80 unless there is a lateral force on the stapler against which the tab is to react. Such force may be, for example, from a user pushing sideways as well as down on handle 30, and therefore body 10, where tab 54 presses against edges of opening 84 with a force directly proportionate to the user's sideways applied force. See also FIG. 13 where the base and body have been pivoted slightly apart. The protrusion of tab 54 is minimal so that tab 54 does not enter the space enclosed by track 80 where tab 54 could interfere with the staple feeding system within track 80. Spacer spring 52 holds the body of the stapler above cover plate 50 so that papers can be inserted under the stapler. Spacer spring 52 may be formed as shown, from a cut out portion of the material of cover plate 50. In this manner no extra parts are needed to include the spacer spring. Spring 52 is preferably tapered from a wide attaching end to a narrower distal end for efficient energy storage. The tapered design also ensures that spring 52 is very rigid in the lateral direction, the spring being fixed laterally, vertically in the page of FIG. 19, in relation to cover plate 50, while still movable downward, vertically in FIG. 18. Spring 52 deflects toward cover plate 50 as body 10 is forced toward base 20 during normal use.

Spring 52 extends upward and forward. The resulting geometry ensures that spring 52 will not interfere with any papers that are inserted all the way to sidewalls 23; FIG. 9 shows this subject well.

Tab 54 aligns in the lateral direction, vertical in FIG. 14, the stapler front directly over anvil 57 of cover plate 50. Opening 84 is elongated front to back to provide for translation of tab 54 along track 80 as the stapler body pivots toward base 20. Shoulder 53 slides against the bottom of track 80 during the translation. The distance between tab 54 and hinge connection 22 of base 20, FIG. 7, defines the moment arm available to align the front of the body over anvil 57 at the front of cover plate 50. A longer distance provides more accurate lateral positioning. As discussed above, spring 52 includes a rigid attachment to cover plate 50 so that spring 52 can provide secure lateral positioning. In a typical stapler, sidewalls 23 are bearings that extend forward to form this moment arm to react against sideways forces. However, the closer the sidewalls are to the anvil, the less cantilever or overreach is possible to staple toward the center of a paper sheet. In the present invention, paper can extend fully up to small sidewalls 23, passing under spring 52. A further advantage of the positioning design of the invention is that base 20 may be plastic resin that is less stiff than the die cast or steel base typically used. Tab 54 provides a stiff steel element to position a forward portion of the body. For best effect tab 54 and opening 84 should be similar in width, into the page of FIG. 7, so that tab 54 will not move laterally in opening 84. According to the above description, a single sheet metal element provides four distinct functions: a cover plate for a base, a spacer spring, a lateral positioner for the body, and a staple-forming anvil.

Base 20 includes elongated raised under-portion 24 to provide a gap between a tabletop and the stapler. The gap creates a substantial area from which to get fingers under and lift the stapler. Front foot 26 and rear foot 25 are features that serve to hold up raised portion 24. Raised portion 24 has a convex outer cross-sectional surface to further facilitate inserting fingers under base 20. To form the main component of convex base 20 by molding, a reasonably thin wall must be used according to standard molding practice. The thin wall creates cavity 27, FIG. 20, enclosed by base cover plate 50. Note in FIG. 20 the edges of cover plate 50 are enclosed by a thin tapered wall section of base 20 as cover plate 50 rests on inset shelf 251. The base of the stapler is thus a smooth solid form on its exterior. Using a sheet steel cover plate that extends much of the length of the base creates a laminated structure providing additional stiffness to the base assembly of FIGS. 18 to 20.

Cover plate 50 is held to base 20 without the use of additional components or specialized operations. Tab 56 of the cover plate extends below undercut 256 of base 20, FIG. 18. Ribs 250, or another part of base 20 near sidewalls 23, create a friction fit to hold cover plate 50 against shelf 251. Ribs 250 engage corresponding notches in the cover plate to position cover plate 50 longitudinally, left to right in FIG. 19. To assemble, cover plate 50 is tilted so that tab 56 enters undercut 256. The cover plate is then lowered at its rear and pressed into place between sidewalls 23. Spacer spring 52 normally provides pressure to hold cover plate 50 down at its rear giving a redundant holding feature. Cavity 27 may include flattened portion 227 to fit a steel bar for additional weight in the base.

The rear end of the stapler of the invention presents a clean, simple appearance, FIG. 4. Sidewalls 23 are joined by rear wall 29, FIGS. 14*a, b* and 17, largely enclosing the lower rear end of body 10. Recess 16 in body 10 fits retractable track pull 60, FIGS. 15 and 16. Sidewalls 23 normally surround these elements so that they do not show. Body 10 rotates about post 15 at hinge connection recess 22 on sidewalls 23. Post 15 is seen best in FIGS. 12 and 14*c*. Hinge connection 22 is seen best in FIGS. 14*c* and 17. These features are shown as hidden lines in FIGS. 15 and 16 for reference. Alternatively, the post may extend from sidewalls 23, while the recessed hinge connection may be in body 10. In the illustrated embodiment track pull 60 includes extension 67. As the stapler body is forced to pivot about hinge connection 22, extension 67 passes against an upper edge of wall 29, FIG. 14*b*. Wall 29 forms a detent to control the motion of the body pivoting from the base. In a normal rest position, where body 10 is upright above base 20, spring 52 holds the body up in a body rest position to provide clearance for papers, with spring 52 being held slightly deflected down by the detent formed by extension 67 against wall 29 below hinge of pivotal attachments 15 and 22. Further upward force overcomes the resistance of the detent to unload the spring and allow the body to be fully pivoted behind the base, to an upside down and rearward extending position, FIG. 15. With the above-described structure, the mechanism used for loading staples is not visible until it is needed.

Using extension 67 to hold the body with a slight preload on spring 52 provides a stiff structure. If, for example, the body were held down at tab 54 of spring 52 by a frictional engagement between tab 54 and opening 84, the body would bounce over the base since an unloaded spring is doing all of the holding. This would suggest low quality design.

Figure 14B:
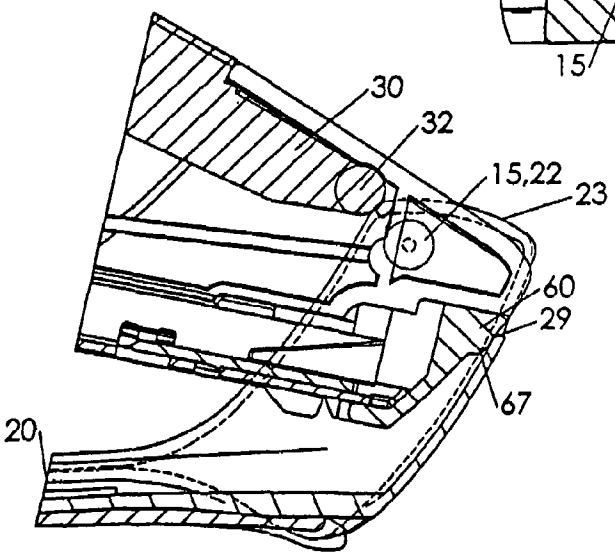
FIG. 14*b* is the view of FIG. 14*a*, with the body pivoted upward.
Figure 14A:
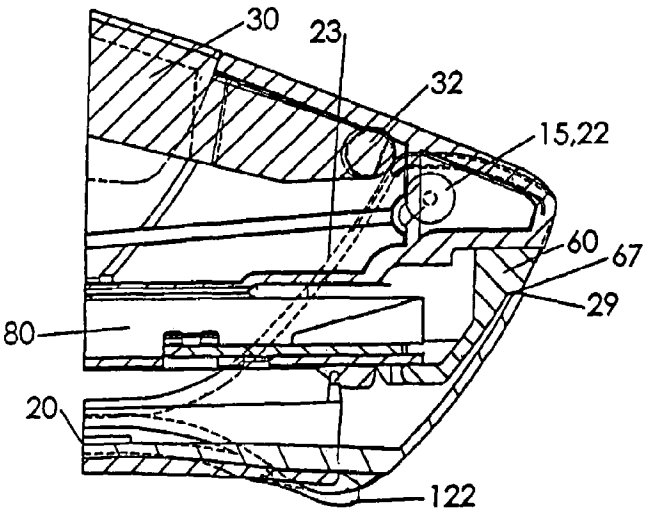
FIG. 14*a* is a partial side sectional view of the stapler of FIG. 14.
Figure 15:
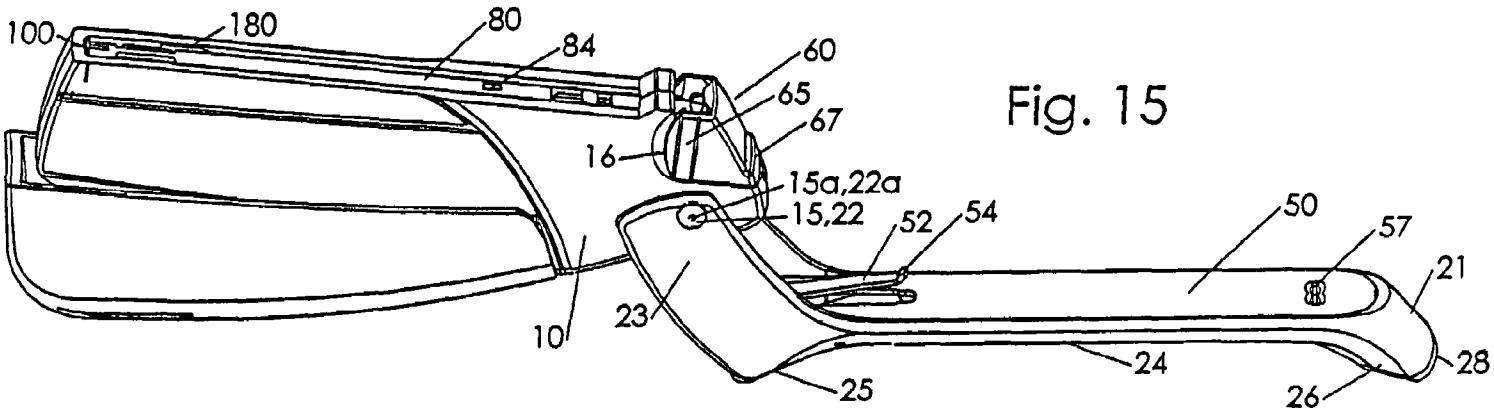
FIG. 15 is an upper-right side view of the stapler, with the body pivoted fully to the rear of the base.
Figure 16:
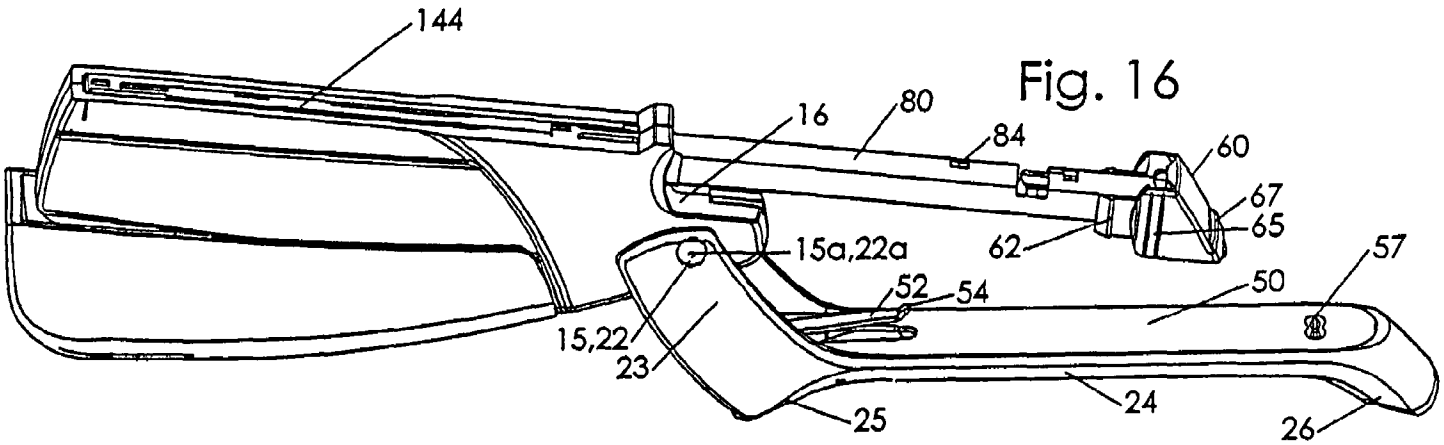
FIG. 16 is the stapler of FIG. 15, with the track opened for staple loading.
Figure 24:
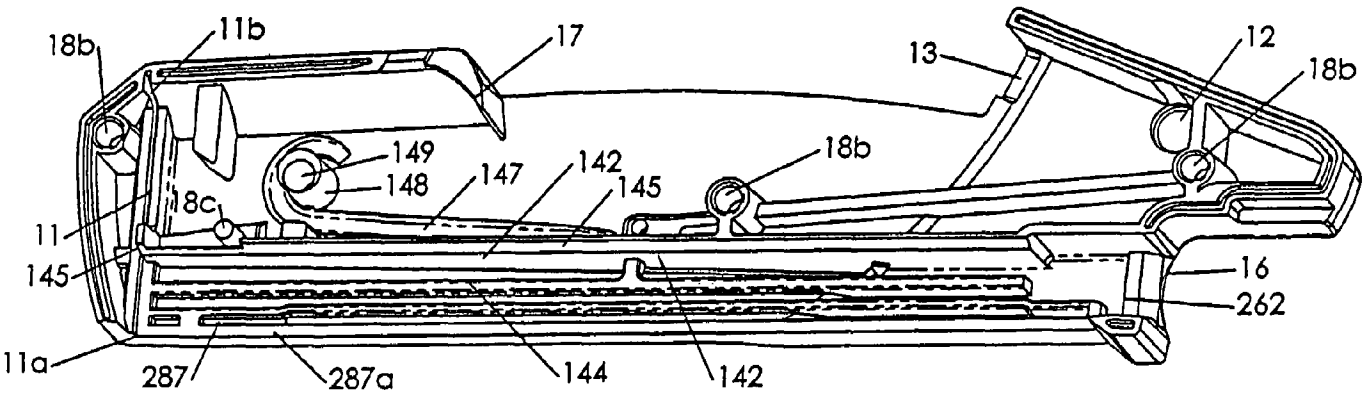
FIG. 24 is a lower-side rear interior view of a right housing half.

Squeezing track pull arms 65 releases track locks 62 from catches 262, FIGS. 16 and 24, of the body. The track can now be pulled rearward by retracting track pull 60, FIG. 16, to expose staple loading chamber 144. In the open position the body is upside down and rearward of the base, FIG. 15. Track pull 60 is now above hinge connection 22, facing forward or oppositely from its normal rearward orientation under the hinge, FIG. 14*a*. Using extension 67 of track pull 60 adds resiliency to the detent system that engages rib 29 since the track pull is slightly movable within recess 16 in the normal engaged position of track pull 60; FIGS. 14*a*, 14*b*. Resiliency within a detent action enhances the feel and reliability of the detent action since some give is needed for the detent to release. Alternatively, extension 67 could be a direct element of body 10 or further component of the stapler. If extension 67 were rigid it could be desired that rib 29 be a resilient cantilevered tab of base 20 created by, for example, two parallel vertical slots in rib 29 near sidewalls 23 with respect to the view of FIG. 20.

Figures 26, 27, 28, 29, 30, 31, 32, 33:
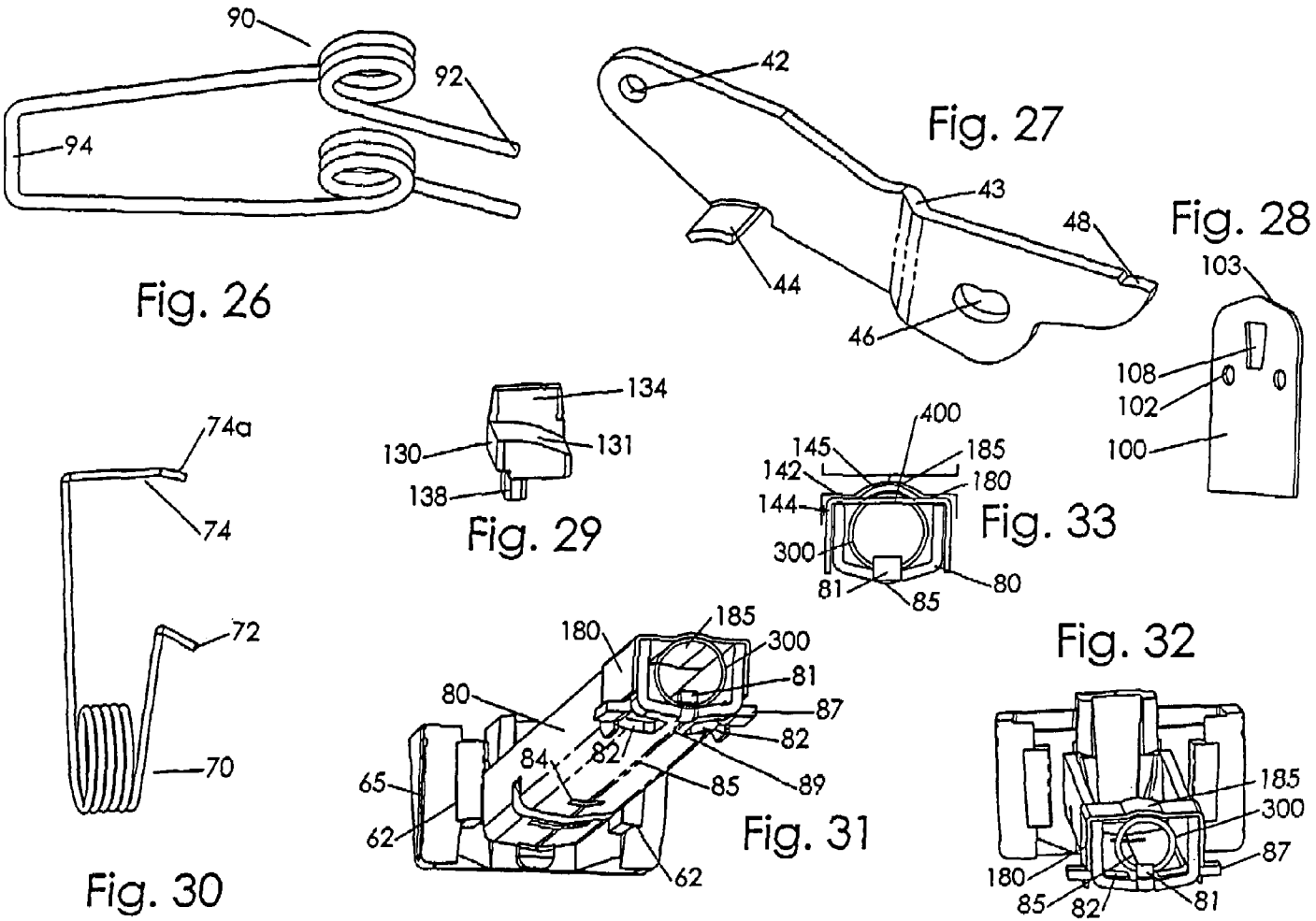
FIG. 26 is an isometric view of a power spring in a rest position.
FIG. 27 is an isometric view of a lever.
FIG. 28 is an isometric view of a striker.
FIG. 29 is an isometric view of a slip link.
FIG. 30 is an isometric view of a re-set spring in a rest position.
FIG. 31 is a lower-front right side view of a track assembly.
FIG. 32 is an upper-front right side view of the track assembly.
FIG. 33 is a front view of the rack assembly within a cut-away portion of a staple-loading chamber.

Staple pusher 180 fits over track 80 to urge staples (not shown) that are guided by track 80 toward striker 100, FIGS. 31 and 32. Extension spring 300 is secured at a spring front end under loop 81 of the track. A rear end of the spring attaches to pusher 180 to urge the pusher forward. Spring 300 is represented schematically by a single typical coil of spring 300. Spring 300 in fact extends axially within the space enclosed by track 80 and pusher 180. Although spring 300 is a low force spring, it must store energy over a long distance to urge every staple in a long rack of staples forward. For example, a typical rack of standard staples is about 4 inches long. So spring 300 must extend 4 inches from its rest position, while maintaining a preloaded bias force in the rest position. The spring rest position corresponds to the last single staple of the rack of staples when pusher 180 is fully forward. In the figures, the pusher is shown near to the spring rest position.

To store the most energy spring 300 needs a maximum number of coils and maximum coil diameter, to effectively pack the longest possible wire in the available space. This possible wire length is a function of the overall length of track 80 and an internal area enclosed by both the track and the pusher that can fit the coil diameter. The internal transverse cross-sectional area of the track with pusher is determined by the size of the staples that the track is designed to carry. A wider track will not fit within a specified staple leg dimension, and a taller track will require striker 100 to rise higher than necessary to clear the top of the staples, requiring a taller overall stapler device since striker channel upper end 11*b* would need to be higher. Standard desktop staples are relatively wide and short compared to tacker staples.

According to the present invention, a larger interior space enclosed by the track for the coil of spring 300 is provided by creating an effectively taller space, while still fitting wide short staples. In FIGS. 31 and 32 the bottom of track 80 is not flat, having an elongated crease 85. In the prior designs, the level of the bottom of the track has been the same as tabs 87, which fit into channels 287, FIGS. 24 and 25. There is a rib 287*a* under channel 287 defining a gap between tab 87 and the underside of housing 10. See also FIG. 13. It is important that the track does not protrude below the underside of the housing since the track would hold the housing away from papers to be stapled. However, the thickness of rib 287*a* is an available space into which the track may protrude without interfering with the function. In FIGS. 31 and 32 the center of track 80 is lowered at crease 85, by part of the thickness of rib 287*a*. This lowered portion allows increased diameter for the coil of spring 300, where spring 300 is centered across the width of track 80.

To further increase the available spring area, pusher 180 includes centrally aligned arcuate hump 185 co-axial with the coils of spring 300. Arcuate channel 145, FIGS. 24, 25 and 33, extends into ceiling 142 of loading chamber 144. In FIG. 33 staples 400 are shown in front of pusher 180. Ceiling 142 provides an upper vertical confinement for holding staples 400 on track 80. However, such confinement need only be at each side of the staple, so hump 185 may protrude up, with lower shoulders to each side at the conventional height, providing extra space for the coil of spring 300. Hump 185 need not be precisely arcuate or precisely co-axial with spring 300.

Tabs 87 are formed from cutouts 82 of the bottom of track 80. Rib 89 forms a divider between cutouts 82. This design contrasts with that of U.S. Pat. No. 5,699,949 (Marks) where the tabs are formed from cutouts of the track sides. Using cutouts from the bottom is desirable in the present invention light duty stapler where the staples and thus the track sides are short compared to staple gun tackers. Forming the tabs from the sides would leave little material on the side. Rib 89 provides stiffness to the bottom of the track.

Figure 25:
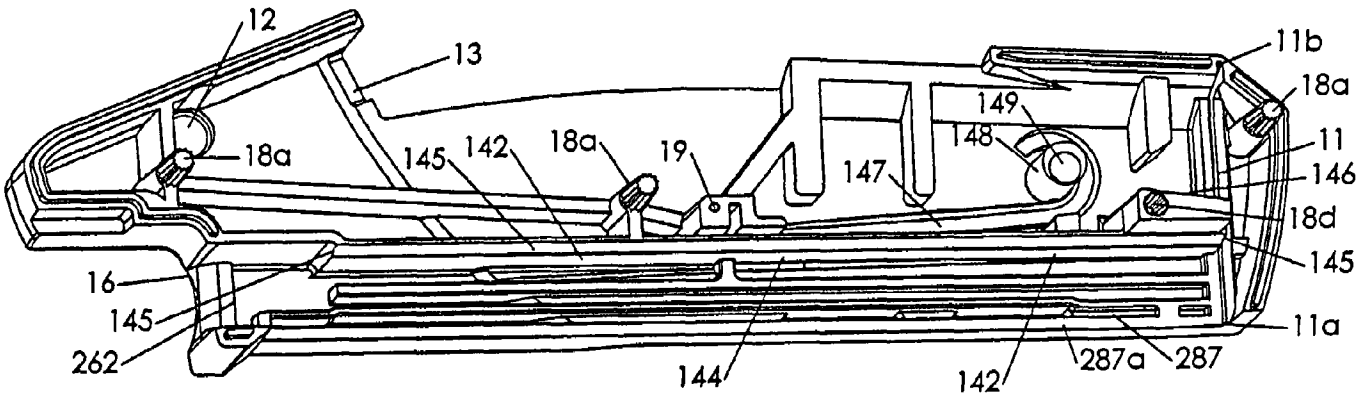
FIG. 25 is a lower-side rear interior view of a left housing half.

Bumper 146 provides a stop for power spring 90, FIGS. 6 and 25. The impact force from spring 90 is directed toward the outer portions of housing 10 since the power spring is in two separate spaced arms at striker 100. The outer portion is the thicker areas of ceiling 142, away from channel 145, FIG. 33. So ceiling 142 provides good support for bumper 146. The left and right halves of housing 10 may be fastened with screws, welds, glue, or other well-known means. In the illustrated embodiment, serrated posts or holes are used. The left half of housing 10, FIG. 25, includes three serrated posts 18*a*, and one serrated hole 18*d*. The right half, FIG. 24, includes three smooth holes 18*b* and one smooth post 18*c*. With one element of each pair serrated, a reliable interference fit is possible to press the housing together, as the sharp edges of the serrations are gently crushed. The interference fit holds the assembly together as ultrasonic welding or glue are used to securely bond the housing halves. Such bonding may be on the posts directly or other areas of housing 10.

Figure 12:
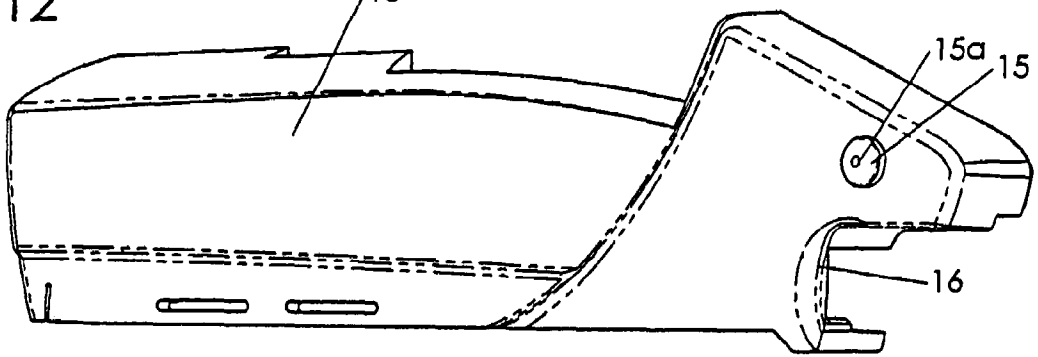
FIG. 12 is a side-rear exterior view of a left housing half of the stapler.
Figure 14C:
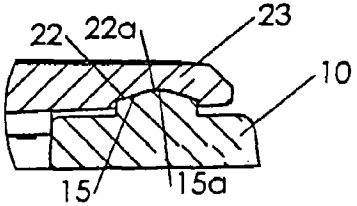
FIG. 14*c* is a partial cross-sectional view of the stapler of FIG. 14.
Figure 17:
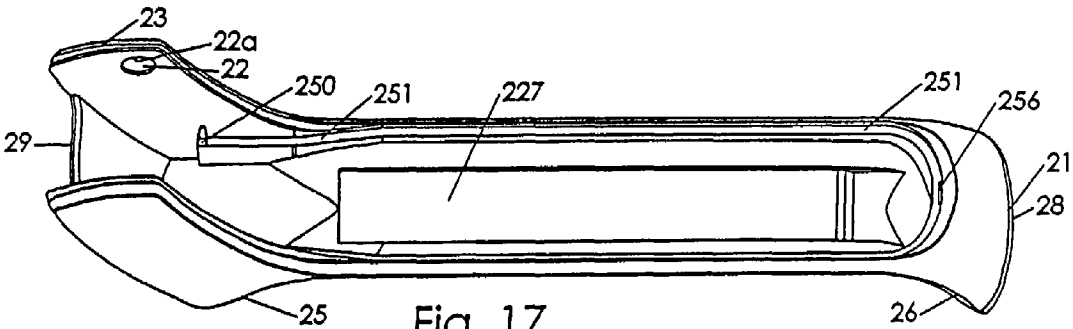
FIG. 17 is an upper-right side view of a stapler base.

Hinge connection 22 with post 15 is shown in cross-section in FIG. 14*c*, with the individual elements in FIGS. 12 and 17. Post 15 includes a main diameter and extends from both left and right housings 10. Posts 15 include a tapered end with small diameter end 15*a*. Small end 15*a* engages small end 22*a* of hinge connections 22. The respective small end diameters are preferably the same. Optionally, the taper leading to small end 15*a* is steeper than that of 22*a*. Further the spacing of sidewalls 23 with hinge connections 22 may be slightly smaller than the distance between left- and right-side posts 15. Then small ends 15*a* will be pressed by small ends 22*a*. The effect is then similar to a needle bearing, where small ends 15*a* are precisely located by wedging within the recesses of hinge connections 22, at 22*a*. Since the diameters of the small ends are much reduced from the main diameters of the associated features, there is minimal friction against rotation even as there is some wedging. This precise locating works with the moment arm discussed above with respect to tab 54 and opening 84 to position the front end of the stapler over 30 anvil 57.

For assembly, housing 10 is forced in-between sidewalls 23. The tapered ends of posts 15 from ramps to spread apart sidewalls 23 as posts 15 begin to press edges of sidewalls 23 during assembly. Hinge connections 22 are at movable portions of sidewalls 23, FIG. 17, since there is no cross member adjacent to connections 22 to rigidly bind them in relative position. The closest such member. is rib 29. Thereof, no separate fasteners are required to connect housing 10 to base 20.

What is claimed is:

1. A desktop stapler, comprising:

an elongated base;

a body pivotably attached to the base toward a rear end of the stapler wherein a closed position includes the base and the body extending forward from the pivotal attachment in a parallel and spaced relationship between the base and the body, the body being upright in the closed position;

an open position of the stapler where the body is pivoted about the base to an upside down position, and the body extends rearward from the pivotal attachment;

the base including two sidewalls that extend up to partially surround sides of the body, a rear wall of the base that extends up in a direction of the sidewalls and joins the sidewalls from behind the body in the closed stapler position, the base thereby fully enclosing a lower rear end of the body in the closed stapler position;

a detent extension is attached to the body, the detent extension is below the pivotal attachment in the closed stapler position, the detent extension presses a rib of the base, the detent extension providing a releasable upper limit to hold the body in a rest position above the base, and wherein the detent extension is an element of a retractable track pull, the track pull is movable in relation to the body in the track pull engaged position, and the detent extension resiliently presses the rib of the base; and the lower rear end of the stapler being above the pivotal attachment and exposed outside the base in the open stapler position.

2. A desktop stapler, comprising:

an elongated base;

a body pivotably attached to the base toward a rear end of the stapler wherein a closed position includes the base and the body extending forward from the pivotal attachment in a parallel and spaced relationship between the base and the body, the body being upright in the closed position;

an open position of the stapler where the body is pivoted about the base to an upside down position, and the body extends rearward from the pivotal attachment;

the base including two sidewalls that extend up to partially surround sides of the body, a rear wall of the base that extends up in a direction of the sidewalls and joins the sidewalls from behind the body in the closed stapler position, the base thereby fully enclosing a lower rear end of the body in the closed stapler position;

a detent extension is attached to the body, the detent extension is below the pivotal attachment in the closed stapler position, the detent extension presses a rib of the base wherein the rib of the base is an upper edge of the rear wall, the detent extention providing a releasable upper limit to hold the body in a rest position above the base; and the lower rear end of the stapler being above the pivotal attachment and exposed outside the base in the open stapler position.

3. The desktop stapler of claim 2, wherein a staple track includes a retracted position, the staple track extending from the body toward a front of the base when the stapler is in the open position and the track is retracted.

4. The desktop stapler of claim 3, wherein the track is above the pivotal attachment in the retracted position of the track.

5. The desktop stapler of claim 2, wherein the base at least partially encloses a track pull.

6. A desktop stapler, comprising:

an elongated base;

a body pivotably attached to the base toward a rear end of the stapler having a closed position with the base and the body extending forward from the pivotal attachment in a parallel and spaced relationship and an open position of the stapler where the body is pivoted about the base toward a rearward body position;

means for ejecting staples from the body held inside the body;

a staple guide track holding staples and slidably disposed in the body beneath the means for ejecting staples, wherein the staple guide track includes a track pull having an extension that is an element of the track pull, and wherein the track pull is movable in relation to the body;

parallel sidewalls of the base extending on opposite sides of the body at the rear end of the stapler;

complementary means for pivotal attachment of the base and the body, disposed on the sidewalls and the body; and a back wall of the base joining the sidewalls with an upper edge of the back wall forming a rib and at least enclosing the track pull, wherein the rib selectively engages the extension of the track pull creating a detent as the body is pivoted against the base between the open and closed positions.

7. The desktop stapler of claim 6, wherein the complementary means for pivotal attachment includes a post extending from and integral with the body and engaging a recess formed into the sidewalls.

8. The desktop stapler of claim 7, wherein the post includes a conical end and the recess includes a complementary concave shape.

9. The desktop stapler of claim 6, wherein the complementary means for pivotal attachment includes a post extending from and integral with the sidewalls and engaging a recess formed into the base.

10. The desktop stapler of claim 6, wherein the back wall selectively, frictionally engages the extension of the track pull creating the detent as the body is pivoted against the base between the open and closed positions.

11. The desktop stapler of claim 6, wherein the sidewalls include resilience for temporary outward bending creating a clearance such that the body and posts can pass therebetween for assembly.

12. A desktop stapler, comprising:

an elongated base including a rib;

a body pivotably attached to the base at a rear end of the stapler having a closed position with the base and the body extending forward from the pivotal attachment in a parallel relationship, and an open position of the stapler where the body is pivoted about the base toward a rearward body position;

spring energized means for ejecting staples from the body held inside the body;

a staple guide track holding staples disposed beneath the spring energized means for ejecting staples, wherein the staple guide track includes a track pull with an extension projecting from a rear end thereof;

opposed sidewalls of the base extending on opposite sides of the body at the rear end of the stapler;

complementary means for pivotal attachment of the base and the body, disposed on the sidewalls and the body; and a back wall of the base joining the sidewalls, wherein the rib of the base is an upper edge of the back wall and the rib selectively engages the extension of the track pull creating a detent between the body and the base as the body is pivoted against the base between the open and closed positions.

13. The desktop stapler of claim 12, wherein the complementary means for pivotal attachment includes a post and a concave recess.

* * * * *